United States Patent [19]

Kono

[11] 4,168,913

[45] Sep. 25, 1979

[54] PROCESS FOR MIXING PARTICULATE MATERIAL

[75] Inventor: Motomi Kono, Chiba, Japan

[73] Assignee: Kabushiki Kaisha Ako Sutherland Company, Tokyo, Japan

[21] Appl. No.: 850,678

[22] Filed: Nov. 11, 1977

[30] Foreign Application Priority Data

Mar. 22, 1977 [JP] Japan ..... 52/31366

[51] Int. Cl.[2] ..... B28C 5/06; B01F 13/02; B01F 13/06

[52] U.S. Cl. ..... 366/3; 366/101; 366/107; 366/139

[58] Field of Search ..... 366/101, 105, 106, 107, 366/139, 3

[56] References Cited

U.S. PATENT DOCUMENTS

| | | | |
|---|---|---|---|
| 1,839,456 | 1/1932 | Anderson | 366/107 |
| 3,276,753 | 10/1966 | Solt et al. | 366/107 |
| 3,671,018 | 6/1972 | McKibben et al. | 366/107 |
| 3,887,337 | 6/1975 | Descamps et al. | 366/101 X |
| 4,042,220 | 8/1977 | Humkey et al. | 366/101 |

FOREIGN PATENT DOCUMENTS

| | | | |
|---|---|---|---|
| 732062 | 4/1966 | Canada | 366/107 |
| 451717 | 8/1936 | United Kingdom | 366/139 |

*Primary Examiner*—Stanley N. Gilreath
*Attorney, Agent, or Firm*—Spencer & Kaye

[57] ABSTRACT

After evacuating gas in advance from a bin, gas is injected from the bottom of the bin and stirs up particulate material to mix or homogenize the particulate material.

1 Claim, 5 Drawing Figures

PROCESS FOR MIXING PARTICULATE MATERIAL

The present invention relates to a process for mixing particulate material by injecting a gaseous body into a bin thereby stirring up the particulate material within the bin; and also relates to an apparatus for carrying out the process.

There is a need to mix large volume of two or more kinds of particulate material or to homogenize one kind of particulate material. This occurs, for example when two or more kinds of pigments or powdered foodstuffs are to be mixed with each other. And it is known to mix such powdered material by injecting pressurized air into the bin containing the powder thereby stirring up the powder within the bin. In a conventional apparatus for carrying out such process it has been proposed to mount plural fabric filter bags adjacent to an outlet of the gaseous air. The filter bags separate the gas from the stirred up powder material and discharge the gas only therethrough.

When such fabric filter bags are provided in the bin, however, foreign bodies might be mixed into the powder material from the interior of the filter bags, which is objectionable in the case of foodstuffs or medicine. In particular, when the particulate material is changed, if old material is stuck to the filter bag surfaces, it might be mixed into the new material. Furthermore, when a considerable number of the filter bags are provided, cleaning of the bin becomes troublesome. And if static electricity is generated due to friction between the filter bag surfaces and the powder particles, it may cause a dust explosion.

An object of this invention is therefore to provide a novel process for mixing particulate material, which eliminates the above-mentioned drawbacks.

Another object of this invention is to provide an apparatus for carrying out this process.

In accordance with the present invention, the interior pressure of a bin containing therein particulate material to be treated is lessened beforehand and then a valve in the bottom of the bin is opened so as to inject air therethrough for a short time. The particulate material is thus completely stirred up and circulated in the bin. According to this method, the conventional filter bags may be dispensed with, or at least their number may be lessened. Therefore a large part of the above-mentioned trouble due to the filter bags can be overcome.

The process according to the present invention may be repeated easily and so the mixing efficiency of the mentioned conventional method can be secured.

Details of the present invention are set forth in the following description, with reference to the accompanying drawings in which like parts bear like reference numerals. In the drawings.

Figure 1:
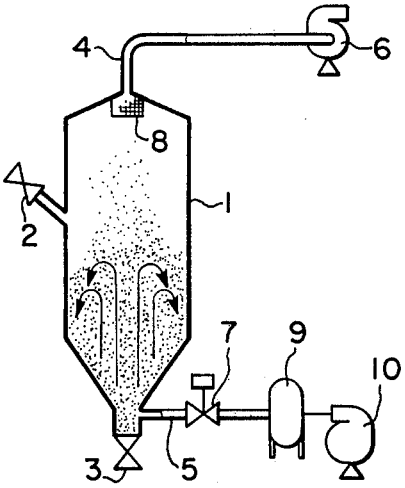
FIG. 1 is a schematic view of one embodiment of the apparatus according to the present invention.

To a bin body 1 is provided a particulate material inlet valve 2. The particulate material is discharged after being treated for mixture of homogenization from a discharge valve 3. The numeral 5 denotes an air conduit through which air is injected into the interior of the bin when an air injecting valve 7 is opened. The numeral 6 denotes a vacuum pump which lets air out of the bin body 1.

According to the process of the present invention, the vacuum pump 6, at first evacuates the bin body 1 through a discharge conduit 4 until the pressure within the bin 1 reaches a certain degree lower than the atmospheric pressure. By opening the air injecting valve 7, air of almost the same volume as was discharged by the vacuum pump 6 is injected into the bin 1 and stirs up the particulate material already in the bin body 1. The numeral 10 is a compressor and the numeral 9 denotes an air reservoir for compressed air supplied from the compressor 10.

Figure 2:
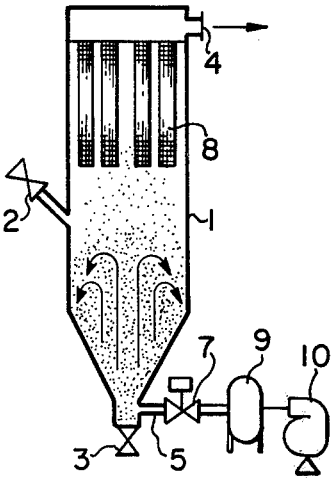
FIG. 2 PRIOR ART
FIG. 2 is a schematic view of the conventinal apparatus.

According to the process of this invention, since air discharge is not necessary during the mixing or homogenizing process, the use of many fabric filter bags as in the known process shown in FIG. 2 process is not necessary. Except in the case of repetition of process the filter 8 is not necessarily needed according to the present invention. It will be furthermore realized that a small filter bag suffices for this purpose.

The result of comparison between the apparatus of this invention shown in FIG. 1 and that of the known prior art shown in FIG. 2 is explained hereinunder referring to the following Table. The comparison is made with 500 liters of the particulate material which is of 0.3 apparent specific gravity and of five microns in its particle diameter.

Figure 3A:
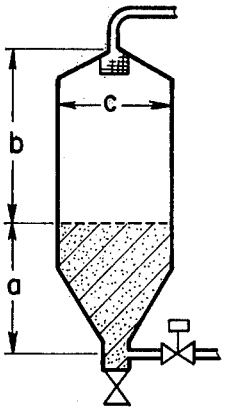
FIG. 3A is a schematic view of the present invention and FIG. 3B is a schematic view of the conventional apparatus showing a comparison between the size of the two apparatuses.
Figure 3B:
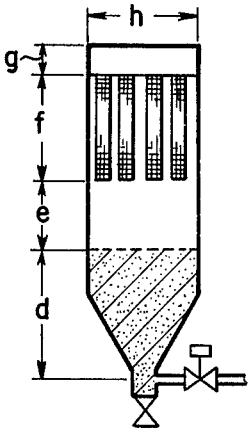

The comparison of the size of both apparatuses is given in relation of FIGS. 3A and 3B, in which the length of a, b, c, d, e, f, g and h are respectively 1200, 1200, 1000, 1200, 500, 1000, 200, 1000 millimeters and are defined as follows:

a and d are the heights of the material in the bins of FIGS. 3A and 3B, respectively, b is the difference between the height of the bin and the height of the material a, c and h are the diameters of the bins of FIGS. 3A and 3B, respectively, f is the length of the filter bag in the apparatus of FIG. 3B, e is the difference between the height of the bin and the sum of the height of the material d and the length of the filter bag f in the apparatus of FIG. 3B, and g is the height of the cavity below the discharge conduit 4.

Table

| | This invention | Prior Art |
|---|---|---|
| diameter of bin | 1000 mm | 1000 mm |
| height of bin | 2400 mm | 2900 mm |
| vacuum pump | atmospheric pressure: −3000mmAq<br>suction: $3m^3$/min.<br>= $0.05m^3$/sec. | none |
| blower | none | atmospheric pressure: +3000mmAq |

Table-continued

| | This invention | Prior Art |
|---|---|---|
| | | volume: $3m^3$/min. = $0.05m^3$/sec. |
| air reservoir | $m^3$ | 1.5 $m^3$ |
| air blow | 0.3 $m^3$/sec. × 1 sec. | 0.3 $m^3$/sec. × 1 sec. |
| blowing | 10 times | 10 times |
| total mixing time | 1 min. | 1 min. |
| surface area of filter bag | 0.5 $m^2$ | 6 $m^2$ |
| passing speed through filter bag | 0.05 $m^3$/sec. ÷ 0.5 $m^2$ = 0.1 m/sec. | 0.3 $m^3$/sec. ÷ 6 = 0.05 m/sec. |

Experiments has been carried out in both apparatuses according to the conditions given in the table. It has been found that the result of homogenization of the particulate material in the apparatuses is the same.

As is apparent from the table, the diameter of the bin is the same as that of the conventional apparatus, while the height thereof is somewhat lower in the apparatus of the present invention compared with the conventional apparatus. The volume of the fabric filter bag(s) is 1/12 of the prior art apparatus. If the volume of consumption of air is almost the same, and equal power is used, the mixing times will be equal. The passing speed of gas through the fabric filter bag is generally determined in accordance with the properties and density of the particulate material used. It will be understood that according to the present invention a double passing speed may be obtained compared with the known apparatus.

According to the conventional apparatus, while the particulate material is stirred up by the air blow, almost the same amount of air must simultaneously be discharged or drawn through the filter bags. On the other hand, according to the apparatus of this invention, since the interior of the bin body is beforehand made low in pressure, air need not be discharged through filter bags during the air blow, and so ample air may be injected into the bin interior from the bottom thereof. In other words, the filter is used in the apparatus of this invention, only after finishing the air blow when almost all particulate material drops to the bottom of the bin and the density thereof is low, in order to separate the residual particulate material at an upper part of the bin. Therefore, while in the apparatus of the conventional art the filter size has been determined by the volume of air introduced into it from the bottom, according to the apparatus of this invention it is determined by the ability of the vacuum pump. And the filter surface area is in inverse proportion to the entire mixing time. It will be understood that the filter may be dispensed with when the ability of the vacuum pump is low and the mixing time is quite long.

Figure 4:
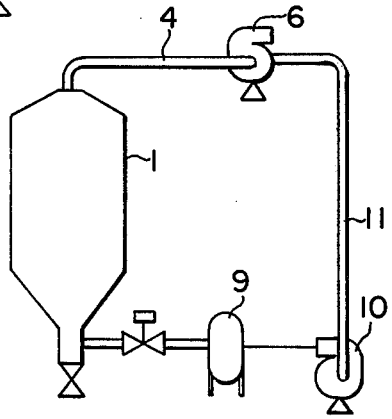
FIG. 4 is a schematic view of another embodiment according to the present invention.

According to another embodiment shown in FIG. 4, the vacuum pump 6 and the compressor 10 are connected for each other through a pipe 11 to permit the passage of gas. According to this construction, recycling of an expensive gas, such as an inert gas, it easily made in case such gas is used instead of air. In this system when the gas is discharged by the vacuum pump for evacuation of the bin interior, it is successively reserved in the high pressure air reservoir 9 by the compressor 10, which is recycled as the gas to be injected into the bin interior 1. This kind of recycling has been impossible according to the conventional apparatus or at least bulky apparatus was needed.

The above description is given mainly in the case of mixing a kind of particulate material with another. But it should be understood that the mixing in this specification covers also the case of homogenization of a single kind of particulate material.

The invention has been described in detail with particular reference to preferred embodiments thereof, but it will be understood that variations and modifications can be effected within the spirit and scope of the invention.

What I claim is:

1. A process for mixing and homogenizing particulate material by injecting gas from an inlet provided at the bottom of a bin in which the particulate material to be treated is contained, which comprises the steps of:

partly filling the interior of the bin with particulate material, evacuating gas from the bin until the gas pressure therewithin falls to a degree sufficiently below atmospheric pressure, and after evacuating the bin to a degree sufficiently below atmospheric pressure injecting pressurized gas through the inlet to said bin in almost the same quantity as the gas evacuated from the bin, the rate of injection of pressurized gas through said inlet being at least six times the rate of evacuation of gas from said bin during mixing of said material.

* * * * *

UNITED STATES PATENT AND TRADEMARK OFFICE

CERTIFICATE OF CORRECTION

PATENT NO. : 4,168,913

DATED : September 25, 1979

INVENTOR(S) : Motomi Kono

It is certified that error appears in the above-identified patent and that said Letters Patent are hereby corrected as shown below:

In the heading of the patent under [73] Assignee, show the assignees as follows:
--Kabushiki Kaisha AKO, Chiba-ken, Japan, and Sutherland Company, Tokyo, Japan--.

Column 2, line 3, change "size" to --sizes--; line 9, change "of" to --or--; line 29, delete "process" (second occurrence).

Column 3, in the Table under the heading "This Invention" in the line starting with "air reservoir" change "$m^3$" to --$1.5m^3$--.

Column 4, line 14, change "for" to --to--; line 17, change "it" to --is--.

Signed and Sealed this

*Twenty-second* Day of *April 1980*

[SEAL]

*Attest:*

SIDNEY A. DIAMOND

*Attesting Officer*

*Commissioner of Patents and Trademarks*